US009408481B1

(12) United States Patent
Pollack

(10) Patent No.: US 9,408,481 B1
(45) Date of Patent: Aug. 9, 2016

(54) GRAPHIC ARTS DISPLAY KIT AND METHOD

(71) Applicant: Edward and Deborah Pollack Fine Art, LLC, Palm Beach, FL (US)

(72) Inventor: Edward Pollack, Palm Beach, FL (US)

(73) Assignee: Edward and Deborah Pollack Fine Art, LLC, Palm Beach, FL (US)

( * ) Notice: Subject to any disclaimer, the term of this patent is extended or adjusted under 35 U.S.C. 154(b) by 0 days.

(21) Appl. No.: 14/725,633

(22) Filed: May 29, 2015

Related U.S. Application Data

(60) Provisional application No. 62/090,186, filed on Dec. 10, 2014.

(51) Int. Cl.
*A47G 1/06* (2006.01)
*A47G 1/14* (2006.01)

(52) U.S. Cl.
CPC ..... *A47G 1/0627* (2013.01); *A47G 1/06* (2013.01); *A47G 1/141* (2013.01)

(58) Field of Classification Search
CPC ..... G09F 3/10; G09F 3/0292; G09F 3/0288; G09F 3/00; G09F 3/02; G09F 2003/023; G09F 2003/0257; G09F 2003/0264; G09F 2003/0267; G09F 2021/041; G09F 7/04; G09F 1/10; G09F 3/20; G09F 7/18; G09F 2007/1852; G09F 21/04; G09F 17/00; B60R 13/00; B60Q 7/005; B60Q 1/50; A47G 1/0627; A47G 1/06; A47G 1/141
See application file for complete search history.

(56) References Cited

U.S. PATENT DOCUMENTS 1,942,174 A * 1/1934 Kaplan ..... A41G 1/00 156/61
3,400,890 A * 9/1968 Gould ..... A41G 1/006 239/36
4,544,590 A * 10/1985 Egan ..... G09F 3/0288 156/234
5,346,455 A 9/1994 Volkert
5,351,426 A * 10/1994 Voy ..... B31D 1/021 40/630
D368,233 S * 3/1996 Spickelmier ..... 428/24

(Continued)

OTHER PUBLICATIONS

The Pinterest-Inspired Family Bouquet, Apr. 2013, http://amethystcat.blogspot.com/2013/04/the-pinterest-inspired-family-bouquet.html.*

(Continued)

*Primary Examiner* — Cassandra Davis
(74) *Attorney, Agent, or Firm* — McHale & Slavin, P.A.

(57) ABSTRACT

The instant invention is a photograph display kit. The kit includes a sticker sheet where the upper layer contains a first perforation in a design defining a photograph printing area, and the backing has a second perforation in a different and larger design defining a border area around the photograph. When an image is printed onto the sticker sheet, the border section with corresponding upper layer can be removed from the sticker sheet, and the portion of the upper layer outside of the photograph printing area can be removed so that a photograph with a border remains. A pipe cleaner, acting as a supporting rod, can then be attached to the back of the photograph and inserted into a base so that the photograph is displayed. A series of photographs can be printed and displayed together in such a manner as to create a fanciful bundle of photographs.

5 Claims, 5 Drawing Sheets

(56) References Cited

U.S. PATENT DOCUMENTS

| | | | | |
|---|---|---|---|---|
| 5,873,607 | A * | 2/1999 | Waggoner | G09F 3/10 283/101 |
| 6,793,999 | B2 | 9/2004 | Wittmeyer, Jr. | |
| D499,766 | S * | 12/2004 | Avilla | D20/29 |
| 7,164,490 | B2 | 1/2007 | Manico et al. | |
| 7,690,121 | B2 | 4/2010 | Lam et al. | |
| 8,602,214 | B2 * | 12/2013 | Raming | G09F 3/0288 206/459.5 |
| 2007/0195683 | A1 * | 8/2007 | Milverton | G11B 23/40 369/275.1 |

OTHER PUBLICATIONS

Build a Photo Garden for Babies & Toddlers, Mar. 25, 2014, http://www.toddlerapproved.com/2014/03/build-photo-garden-for-babies-toddlers.html.*

* cited by examiner

GRAPHIC ARTS DISPLAY KIT AND METHOD

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/090,186, entitled "GRAPHIC ARTS DISPLAY KIT AND METHOD", filed Dec. 10, 2014. The contents of the above referenced application is incorporated herein by reference in its entirety.

FIELD OF THE INVENTION

The present invention is directed to the field of graphic arts displays and a kit for displaying graphic arts; in particular, a user can generate and print an electronic graphic arts image on a combination of adhesive backed and adherend materials in a stacked arrangement and, within moments, convert the two dimensional stack into a dynamic three dimensional decorative border and display stand.

BACKGROUND OF THE INVENTION

Displaying photographs in a commemorative fashion has been well known in the art. For generations, photographs have been displayed in homes and offices, usually by placing them in a frame. Frames to display photographs come in many forms, and can display a single photograph or many photographs within the one frame. However, frames can be very costly and it can be a source of great difficulty to find a good frame for a given photograph.

It has also been well known to create "scrap books," or collages of images. When creating such collections, photographs are often cut into various shapes and glued onto a backing. These pages can be grouped into a book, or left isolated, as a way to capture and display memories of events or people.

Photographs are also a way to present a gift to friends or family. Giving the gift of a photograph is a form of sharing that special moment with another person. This often occurs when a significant event has been captured on the photograph, and there is the desire to share that event. But it can also arise when the recipient of the gift needs the gift to help lift their emotions by helping them feel connected to the subjects of the photograph. It is common to see people bring photographs to persons in hospitals for just such a reason.

With increases in technology, the majority of photographs taken are with digital cameras or cellular phones and the images are stored electronically, eliminating the need to have film developed. Accordingly, printing photographs at home is becoming easier and more common. Home printers with the ability to print quality photographs are becoming more commonplace, and photo printing paper is readily available. However, even when printing photographs at home, the photographs still need a frame or another method to display them.

It is therefore desirable to provide a system and method in the form of a kit where a user can print a photograph and be able to display that photograph, or multiple photographs, in a unique three dimensional display that may provide motion to the photographs in response to subtle air currents and minor motion of the display.

DESCRIPTION OF THE PRIOR ART

U.S. Pat. No. 7,164,490 discloses a system and method for producing custom cut image products by the average consumer by isolating a digital image from a background and placing an order over a communication network to a remote location for producing the selected image.

U.S. Pat. No. 6,793,999 discloses a kit wherein the user can print a decal image onto a decal using a computer printer. The kit includes a base section onto which the decal image may be printed, and an adhesive section which provides the adhesive to affix the base section to the substrate after the design has been printed onto the base section.

U.S. Pat. No. 5,346,455 discloses a method of making pop-up promotional items which can either be mounted in three-dimensional form on a suitable supporting surface by means of pressure-sensitive adhesive carried by the item or can be affixed to facing panels of a letter or pages of a book.

U.S. Pat. No. 7,267,480 discloses a method and apparatus for decorating the dial of a clock with photos, papers, or other embellishments so as to create a decorative personalized memory for the person's home or office through the creation of a specific customized timepiece incorporating memorabilia from the personal special event.

U.S. Pat. No. 7,690,121 discloses a punch tool for the punching of a shape through a sheet of material. The punch tool includes a punch and a die portion disposed within a housing having a slot for receiving a sheet of material.

What is therefore needed is a graphic arts display kit and method that allows a user to generate an image onto specially designed stacked sheets which can then be converted into a dynamic three dimensional display and displayed either alone or in combination with other images in a minimal period of time.

SUMMARY OF THE INVENTION

The present invention is directed to a graphic arts display kit wherein the user can print and display a photographic, or other, image. Using a computer and printer capable of printing photographs, a user can print an image onto a pre-defined region of a sheet of sticker paper. In a preferred embodiment, the sticker paper has a base layer with a cut, or perforation, in a predetermined shape going around the pre-defined printing area so that when separated, the user is left with an image surrounded by a fancifully designed framing region. However, the base layer need not be perforated if a punching tool is to be employed to remove the image from the sheet. The user can then attach a supporting rod to the bordered image and insert the supporting rod into a base to display the image within moments of printing it. The base can hold multiple supporting rods, allowing a user to create an arrangement, or "bouquet," of images within a single base. Alternatively, the image displayed in the base can be a single image. In either case, the image, photograph, photographs, or other, can be changed as desired by the user. In a preferred embodiment, the support rod(s) are constructed to allow the finished display to sway and move in response to gentle breezes or motion.

Accordingly, it is an objective of the instant invention to provide a kit which allows a user to print and display an image in a minimal period of time.

It is a further objective of the instant invention to provide a graphic arts display in which a user can display a grouping of images with ornamental backing in a three-dimensional space.

It is yet another objective of the instant invention to provide a kit allowing a user to display as few as a single image and up to many images at a time.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
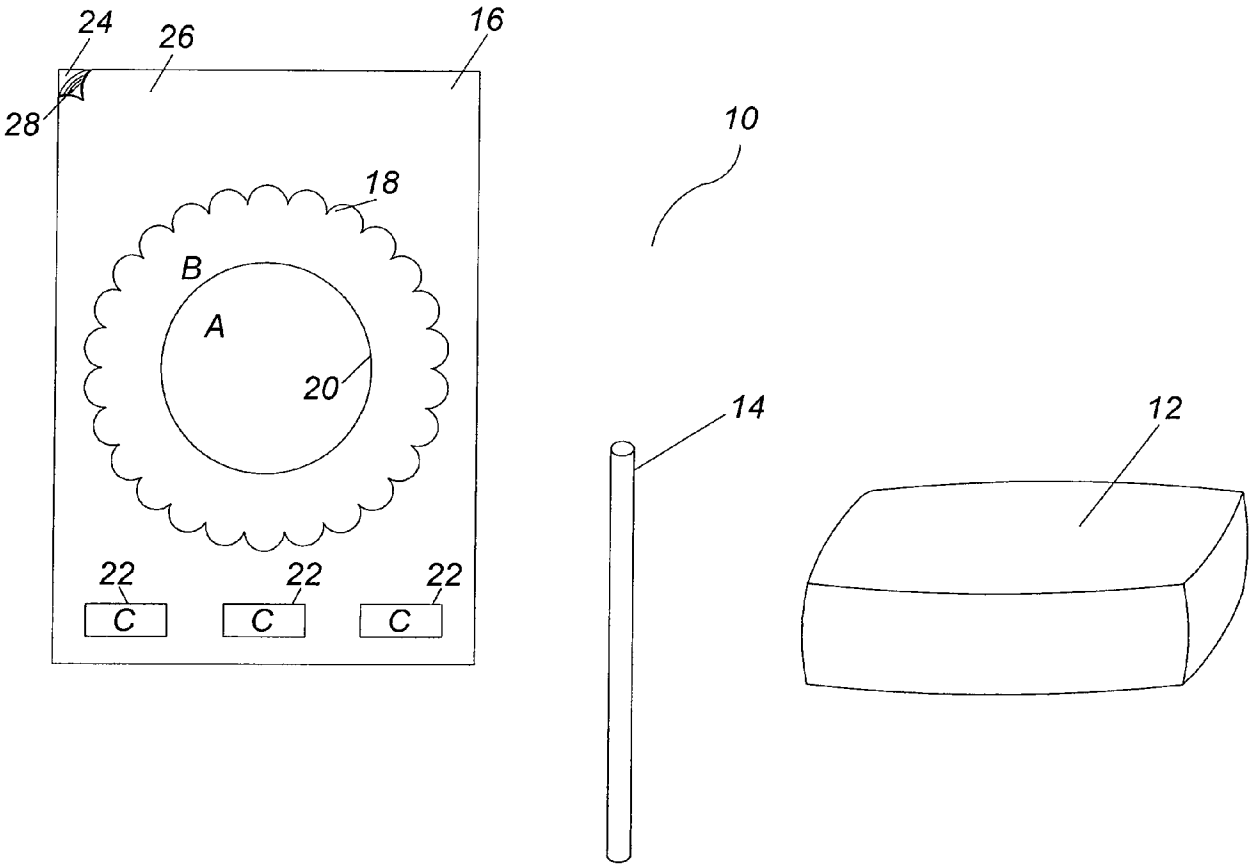
FIG. 1 is a perspective view of the graphic arts display kit of the instant invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Now referring to the drawings in general, disclosed is a graphic arts display kit 10. As seen in FIG. 1, the graphic arts display kit 10 includes a base 12, a support rod 14, and at least one display sheet 16. The kit 10 would preferably include multiple display sheets 16 to allow a user to create a unique collage of images or create a limited, or even only a single, image display 50 (FIG. 2) that can be changed as desired. FIG. 1 shows components of the kit 10, including a base 12 that is receptive to insertion of a support rod 14. In the preferred embodiment clay is used, however other foams and similar materials known in the art can be used without departing from the scope of the invention. Such alternate base materials include dry floral foam, or a container and a sufficient amount of sand, soil, or decorative pebbles, such that the support rod can be inserted into the base enough that the rod can properly display the image.

The support rod 14 of the preferred embodiment is a pipe cleaner; however any rigid or semi-rigid member may be used as the function of the support rod 14 is to hold the image display up from the base 12. When multiple images are displayed, a more semi-rigid support rod 14 allows for better positioning of the image. It should be noted that, in the preferred embodiment, the support rod is sized and constructed to allow swaying movement of the finished display in light breeze or slight vibration.

The image display sheet 16 is made from a supportive backing layer 24 and an upper layer 26 held together by an adhesive 28, and more preferably a pressure sensitive adhesive. The upper layer 26 and supportive backing layer 24 also contain a releasing agent on at least a portion of the connected area, such that the upper layer 26 and backing layer 24 may be peeled away from each other over that portion, yet they are still able to be reattached. The upper layer 26 is designed and coated to be receptive to photographic printing from conventional printers. The adhesive used allows for the display sheet 16 to be processed by a conventional printer without the backing layer 24 and upper layer 26 coming apart.

In the preferred embodiment, the upper layer 26 is made from a polymer material, such as vinyl, so that while the upper later may be cut by a sharp object, it will not tear. The upper layer 26 has a pre-defined printing area A, defined by a cut or perforation 20 in the upper layer 26. An image can then be printed in printing area A using a software application which may include templates. The image printed onto printing area A can be a photograph, text, or any graphic design, including portraits, landscapes, artwork, geometric designs, quotes, sayings, etc. A second cut or perforation 18 defines a border region B on the backing layer 24, which encompasses the printing area A and provides extra space around printing area A. The second cut or perforation 18 can be through either both the backing layer 24 and the upper layer 26, or in the preferred embodiment, just the backing layer 24. Additional perforations 22 can create strips from the upper layer 26 which can be used as securing straps.

In an alternate embodiment, the backing layer does not have the second cut or perforation. In this alternate embodiment, boarder region B can be removed from the backing layer by use of a punch tool. The punch tool cutting portion will be shaped to remove the desired shape for boarder region B from the backing layer. The shapes of the cutting portion can include flower shapes, stars, hearts, balloons, or similar shapes.

Figure 2:
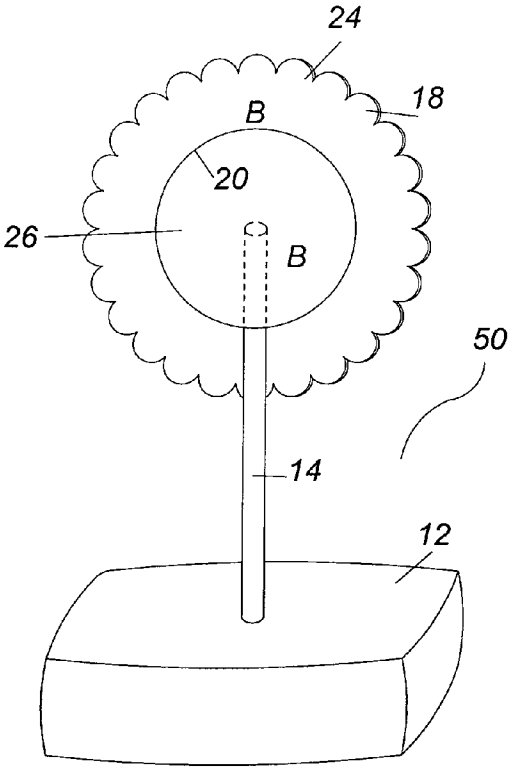
FIG. 2 is a perspective view of the assembled graphic arts display.

Shown in FIG. 2 is one embodiment of the instant invention. Shown here is how the component pieces assemble to form the image display 50. In the preferred embodiment, cut or perforation 18 forms region B into a flower shape and cut or perforation 20 forms region A into a circular photograph, giving the overall appearance of a flower. Region A can be peeled slightly from region B, allowing support rod 14 to be placed between regions A and B. The support rod may be straight or may include curvature on the end thereof. The curvature provides additional surface area for adhesion and prevents rotation of the flower shape around the support rod. The free end of the support rod 14 can be inserted into the base 12, creating an image display 50.

Figure 3:
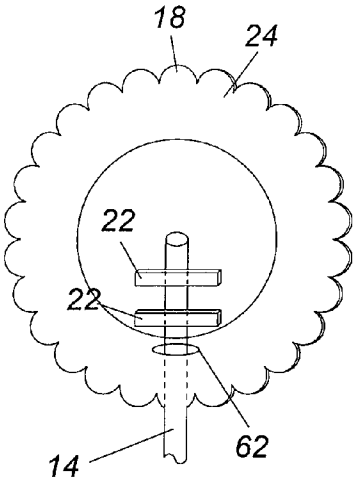
FIG. 3 is a rear view of an alternative embodiment of the graphic arts display kit.

In FIG. 3, an alternate attachment method is shown. In this embodiment, an additional cut or perforation 62 is included in the backing layer 24 wherein the support rod 14 can be inserted through the cut or perforation and secured to the back of the backing layer 24 by securing strips 22.

Figure 4:
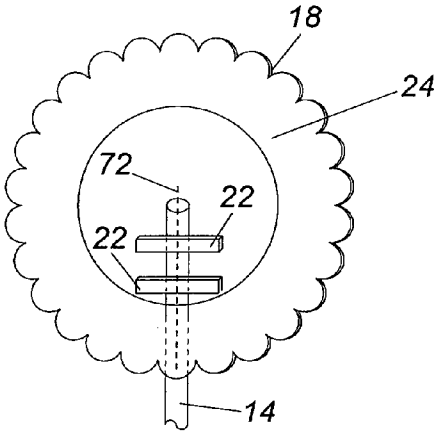
FIG. 4 is a rear view of yet another alternative embodiment of the graphic arts display kit.

In FIG. 4, a preferred embodiment of the attachment method is shown. In this embodiment, a cut or perforation 72 is included in the backing layer 24 running vertically up from the bottom of region B. By splitting the backing layer 24 along cut or perforation 72, a space is created for the support rod 14 to be placed against the adhesive 28 of the upper layer 26. Securing strips 22 are then utilized to secure the closure of perforation 72 around the support rod 14.

Figure 6:
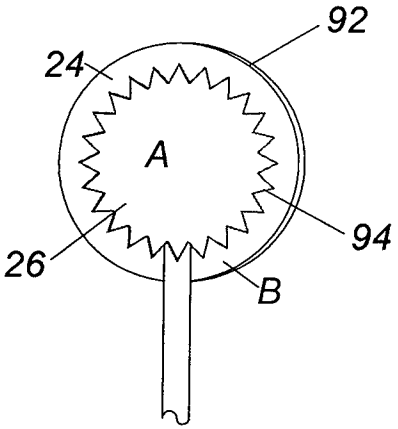
FIG. 6 is a front view of another alternate embodiment of the graphic arts display kit.
Figure 5:
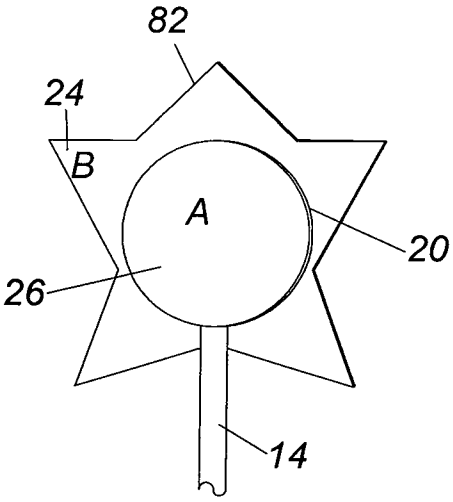
FIG. 5 is a front view of an alternate embodiment of the graphic arts display kit.

FIGS. 5 and 6 show alternate designs for regions A and B. FIG. 5 shows cut or perforation 82 in the shape of a star, while FIG. 6 shows the perforation 92 as a circle while region A is defined by a star cut or perforation 94.

Figure 7:
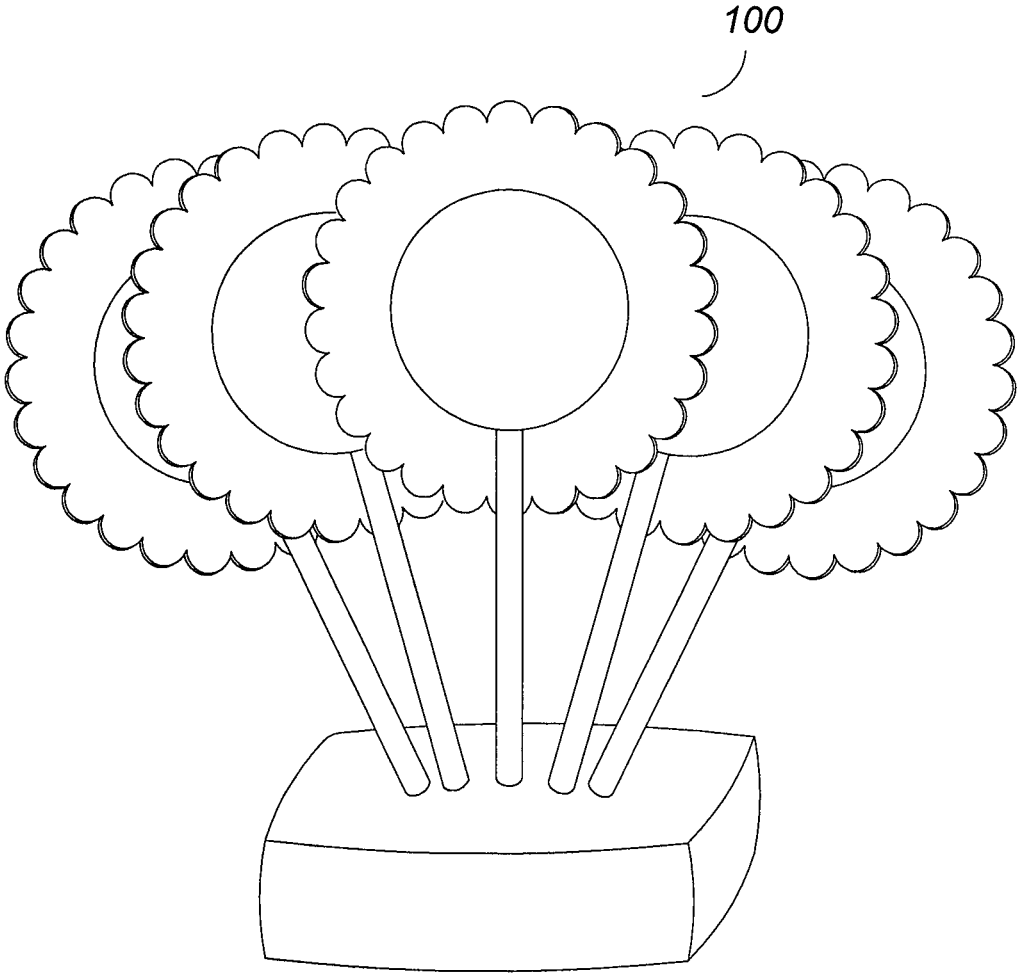
FIG. 7 is an environmental view of a group of images displayed with the graphic arts display kit.

FIG. 7 shows an environmental view of the image display kit 10 with multiple images grouped together in a collage 100. The collage 100 of images displayed uses a flower shape for region B and creates an arrangement, or "bouquet," of these flower to display a variety of images.

Figure 8:
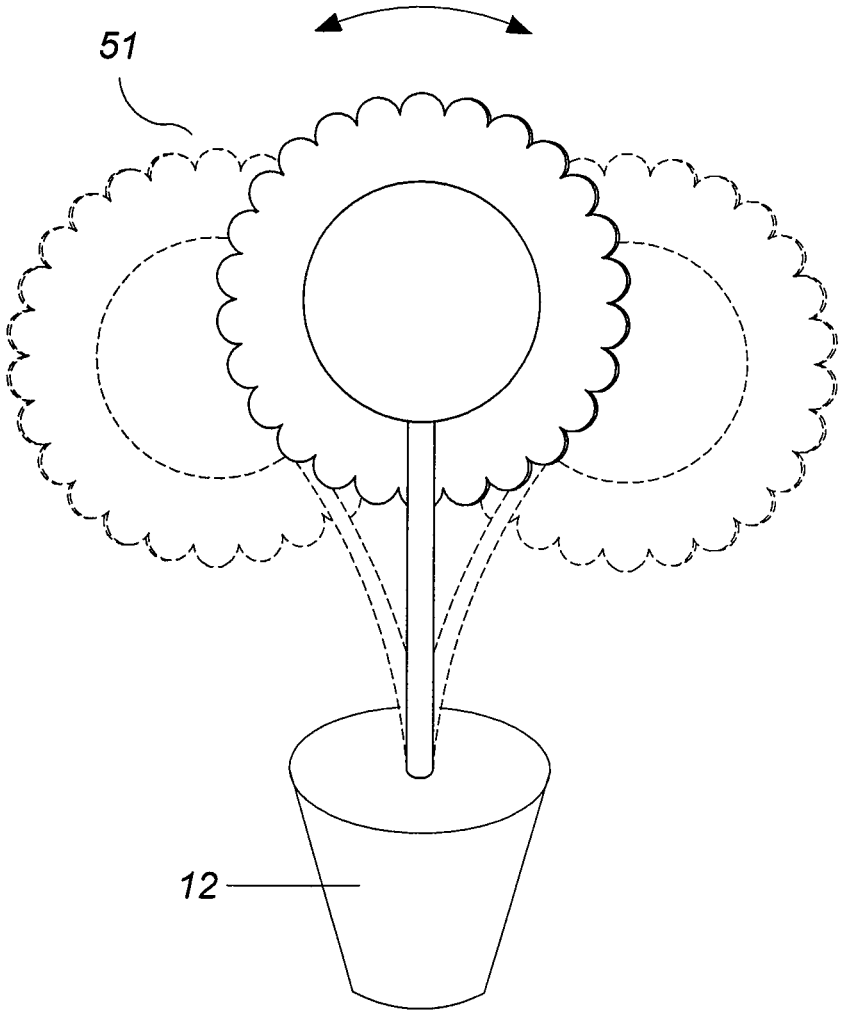
FIG. 8 is an alternate environmental view of an image displayed with the graphic arts display kit.

FIG. 8 illustrates an alternate environmental view of the graphic arts display kit 51. In this view a single image is displayed showing motion of the image due to a breeze or vibration of the display.

In another embodiment of the present invention, the image can be printed on a display sheet 16 that does not contain cuts or perforations to define the printing area. The display sheet 16 is still made from a supportive backing layer 24 and an upper layer 26 held together by an adhesive 28, and more preferably a pressure sensitive adhesive. The upper layer 26 and supportive backing layer 24 also contain a releasing agent on at least a portion of the connected area, such that over that portion the upper layer 26 and backing layer 24 may be peeled away from each other, yet still are able to be reattached. The upper layer 26 is designed to be receptive to the printing of an image from conventional printers. The adhesive used allows for the display sheet 16 to be processed by a conventional printer without the backing layer 24 and upper layer 26 coming apart.

Once printed, the area desired to be displayed can be punched out from the display sheet 16 using a punch tool whereby a given shape is able to be punched out of the display sheet 16. The punch tool operates by receiving the edge of the display sheet 16 into a slot in the housing, which allows for the cutting mechanism to be placed over various regions of the display sheet 16. Upon actuation of the cutting mechanism, a shaped cutter punches out the image from the display sheet 16 from the base layer, punching out region B. A secondary cutting blade can be utilized to press down on the upper layer in a secondary shape defining region A. This secondary cutting blade should only press down enough to cut through region A, without cutting region B. This is accomplished by the secondary cutting blade being constructed with tolerances that do not allow a complete cut through the display sheet 16. With the punch tool, additional blades can be used which allow for variation of the shapes defining regions A and B.

A yet further embodiment of the present invention involves printing the images onto a roll type image display sheet, utilizing a printer. In this embodiment multiple images can be printed onto the roll and then the images can either be punched out utilizing a punch tool, or the roll can incorporate pre-defined printing regions bordered with cuts or perforations to allow for an image to be removed by manually forcing the separation of the image from the remaining portion of the roll.

It should be noted that the preferred embodiment utilizes a pressure sensitive adhesive for connection of the components. Pressure sensitive adhesive is defined herein as an adhesive which forms a bond when pressure is applied to connect the adhesive with the adherend without the need for solvents, water or heat.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A photo display comprising:

a sticker sheet having an upper layer and a base layer secured together with a pressure sensitive adhesive and a releasing agent, said upper layer having a first design region, said base layer having a second region, said first design region being secured to at least a portion of said second region, said first design region constructed and arranged to be removable from said upper layer, said first design region having a first cut or perforation for removing said first design region from said upper layer, said first design region coated to be receptive for printing an image, said base layer having a second cut or perforation within said second region constructed and arranged for receipt of a support rod, said base layer having a third cut or perforation for removing said second region from said base layer;

a support rod having a first end and a second end, said first and of said support rod constructed and arranged to be positioned between said first design region and said second design region and through said second cut or perforation, said second end of said support rod constructed and arranged to be inserted into a base constructed and arranged to receive and support said support rod;

whereby an image can be printed in said first design region, whereby said first design region and said second region are removable from said sticker sheet, and whereby a border is formed from a portion of said second region around said first design region when said first design region and said second region are removed from said sticker sheet.

2. The photo display of claim 1 where said support rod is a pipe cleaner.

3. The photo display of claim 1, whereby said pressure sensitive adhesive is contained on said upper layer and said releasing agent is contained on at least a portion of said base layer.

4. The photo display of claim 1 wherein said support rod first end is constructed and arranged to be positioned between said first design region and said second region by being inserted into said first cut or perforation.

5. The sticker sheet of claim 1 further comprising a fourth cut or perforation on said upper layer, said fourth cut or perforation defining a securing strap region.

* * * * *